United States Patent [19]

Yardas

[11] Patent Number: 4,759,518

[45] Date of Patent: Jul. 26, 1988

[54] TRASH BAG SUPPORT SYSTEM

[76] Inventor: Douglas Yardas, 4523 Buckmoor, San Antonio, Tex. 78217

[21] Appl. No.: 73,736

[22] Filed: Jul. 15, 1987

[51] Int. Cl.[4] ..... B65B 67/12

[52] U.S. Cl. ..... 248/97; 24/462

[58] Field of Search ..... 248/95, 97, 99–101, 248/150; 141/316, 390; 220/404; 24/462, 460, 555

[56] References Cited

U.S. PATENT DOCUMENTS

| | | | |
|---|---|---|---|
| 51,220 | 11/1865 | Reynolds | 248/99 |
| 233,983 | 11/1880 | Clinton | 248/150 |
| 1,052,379 | 2/1913 | Ranken | 248/97 |
| 2,480,412 | 8/1949 | King | 248/150 |
| 3,253,812 | 5/1966 | Okazaki | 248/97 |
| 3,373,963 | 3/1968 | Snell | 248/97 |
| 3,458,110 | 7/1969 | Goldman | 24/555 |
| 3,598,350 | 8/1971 | Kaufman | 248/97 |
| 3,614,041 | 10/1971 | Koger | 248/97 |
| 3,757,990 | 9/1973 | Buth | 248/101 |
| 3,779,419 | 12/1973 | Heitz | 220/63 R |
| 3,796,402 | 3/1974 | Trotta | 248/101 |
| 3,866,872 | 2/1975 | Burgess | 248/150 |
| 3,893,649 | 7/1975 | Cornell et al. | 248/99 |
| 4,157,801 | 6/1979 | Elmer | 248/97 |
| 4,273,167 | 6/1981 | Stillwell | 141/314 |
| 4,376,520 | 3/1983 | Wetherington | 248/97 |
| 4,488,697 | 12/1984 | Garvey | 248/101 |

FOREIGN PATENT DOCUMENTS

| | | | |
|---|---|---|---|
| 247229 | 5/1966 | Austria | 248/97 |
| 1029099 | 5/1953 | France | 248/150 |
| 1286849 | 1/1962 | France | 24/462 |
| 278203 | 11/1964 | Netherlands | 248/97 |
| 259620 | 6/1949 | Switzerland | 248/95 |
| 400007 | 4/1966 | Switzerland | 248/97 |

*Primary Examiner*—J. Franklin Foss
*Assistant Examiner*—Robert A. Olson
*Attorney, Agent, or Firm*—Workman, Nydegger & Jensen

[57] ABSTRACT

A trash bag holder comprises a stand supporting a textured circular support ring over which the lip of a trash bag can be folded. A resilient tube-shaped arcuate clamp engages the ring with a layer of the bag therebetween to hold the bag onto the ring. When engaged with the ring, the ends of the clamp are separated to provide an area in which excess bag material can be accumulated.

5 Claims, 1 Drawing Sheet

TRASH BAG SUPPORT SYSTEM

BACKGROUND OF THE INVENTION

The present invention relates to holders for flexible trash bags. More particularly, the present invention relates to a stand-up holder for supporting a trash bag while the mouth of the bag is held open to facilitate filling the bag. The present invention is particularly, but not exclusively, useful for the collection of trash, garbage and refuse which is to be discarded.

DESCRIPTION OF THE PRIOR ART

Several devices have been proposed for holding limp disposable bags during the collection of trash and other refuse. For example, U.S. Pat. No. 3,253,812 to Okazaki and U.S. Pat. No. 3,598,350 to Kaufman disclose supports for retaining a flexible bag in an open position. Further, various arrangements have been disclosed for the structural engagement between the bag support and the mouth of a flexible bag. Such arrangements include the retainer clips as disclosed in U.S. Pat. No. 4,157,801 to Elmer which secure portions of a limp container to a rim member. Also, such arrangements include structures such as the one disclosed in U.S. Pat. No. 3,893,649 to Cornell et al. wherein a U-shaped groove snaps onto a frame ring with the bag held therebetween.

None of these devices, however, makes specific allowance for the fact that trash bags come in varying sizes and will, accordingly, fit the same trash bag holder differently. The problem is particularly apparent when devices such as these hold the bag by grasping the lip of the bag between a frame and a clamp. With such devices, whenever the circumference of the mouth of the trash bag is substantially larger than the circumference of the frame onto which it is mounted, there will be an unavoidable gathering or accumulation of the bag's material along portions of the frame. This can hinder the effectiveness of the device's ability to hold the bag. One solution to this problem is to clamp the mouth of the bag to the frame at selected points and allow excess bag material to accumulate in the unclamped areas between the attachment points. U.S. Pat. No. 4,157,801 to Elmer generally discloses such a device. There must, however, be sufficient contact between the bag and the trash bag holder to ensure a secure engagement of the bag to the holder. Isolated clamps, such as disclosed in the Elmer Patent, can be ineffective in this regard.

Unlike the devices discussed above, the present invention recognizes that a secure structural engagement between the trash bag support and the bag itself can be accomplished without particular regard for the size of the bag. Additionally, the present invention recognizes that a simplified structure for mounting a bag on a support structure in an open-mouthed configuration is needed to insure ease of operation and reliability of engagement.

In light of the above, it is an object of the present invention to provide a trash bag holder which can be easily engaged with a trash bag to hold the bag in an open-mouthed configuration. It is another object of the present invention to provide a trash bag holder which can effectively hold trash bags of various sizes without an decrease in the effectiveness of the holder that might be caused when an over-sized bag gathers into folds on an under-sized frame. It is still another object of the present invention to provide a trash bag holder that is cost effective, easy to manufacture and reliable in its operation.

SUMMARY OF THE INVENTION

The preferred embodiment of the trash bag holder for the present invention comprises a base having a plurality of vertical supports or struts which are joined to a circular support ring. The support ring is formed with a rough-textured surface to present a high friction interface with the lip of a flexible trash bag when the lip of the bag is folded over the support ring. A resilient tube-shaped arcuate clamp is provided which engages the support ring and holds a single layer of material from the lip of the bag therebetween. The ends of the clamp are sufficiently separated upon engagement of the clamp with the support ring to provide an unclamped portion of the support ring along which excess bag material can be gathered. In an alternate embodiment of the present invention, a plurality of clamps can be provided with the limitation that sufficient separation is provided between the ends of the clamps where excess bag material can be gathered.

The novel features of this invention as well as the invention itself both as to its organization and operation will be best understood from the accompanying drawings taken in conjunction with the accompanying description in which similar reference characters refer to similar parts and in which:

DESCRIPTION OF PREFERRED EMBODIMENT

Figure 1:
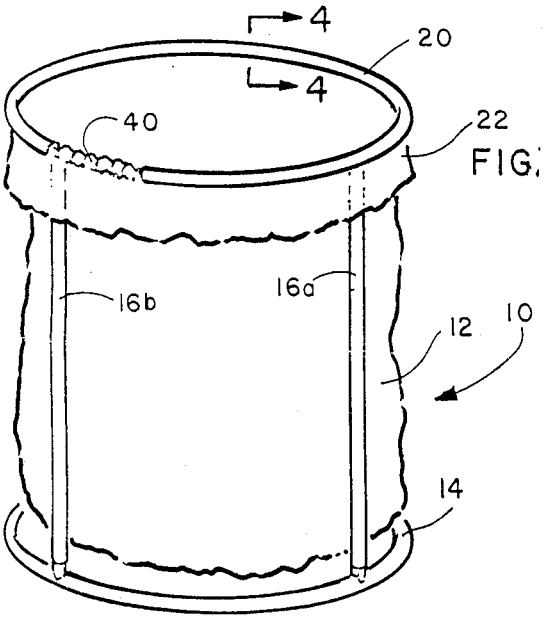
FIG. 1 is a perspective view of the present invention shown holding a trash bag.

Referring initially to FIG. 1, the trash bag holder of the present invention, generally designated 10, is shown holding a trash bag 12. As shown, trash bag holder 10 comprises a base 14 which is joined with a plurality of support struts 16*a, b,* etc. for holding support ring 18. Once support ring 18 is so held it can be operatively associated with a clamp 20 to hold the lip area 22 of bag 12 therebetween.

It will be appreciated by the skilled artesan that a cover (not shown) can be placed around or on supporting ring 18 when it is engaged with clamp 20 to enclose the trash or refuse within bag 12. This will capture unwanted odors and help prevent spillage of the contents of bag 12.

Figure 2:
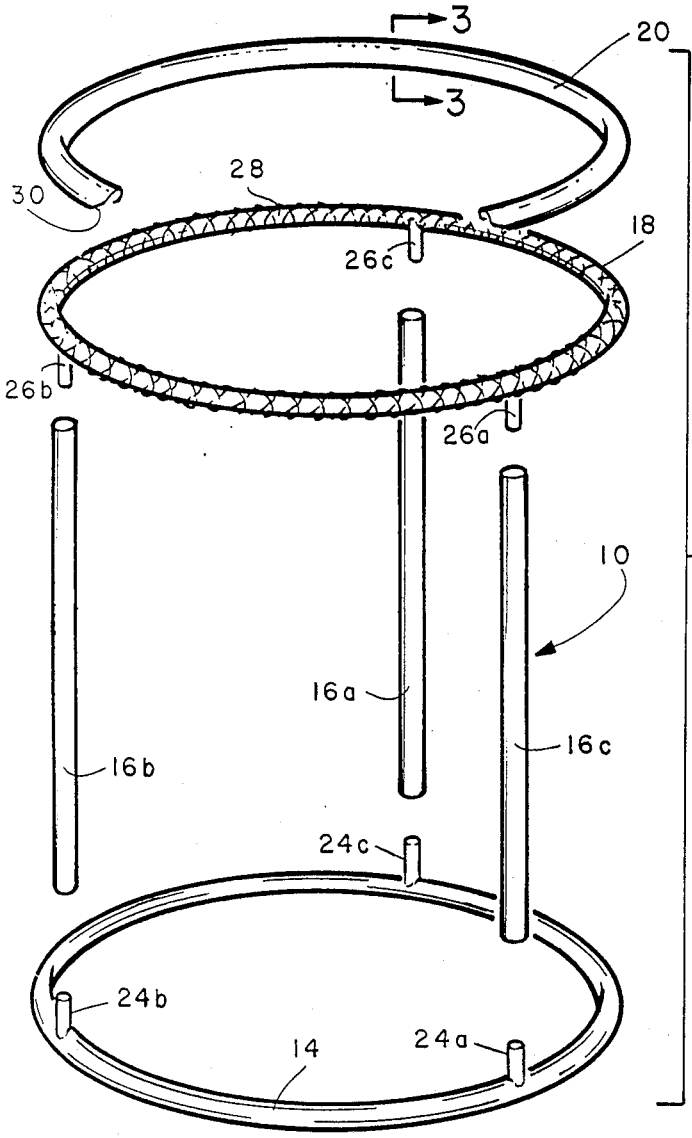
FIG. 2 is an exploded perspective view of the present invention.

A more detailed description of trash bag holder 10 is best appreciated with reference to FIG. 2. As shown in FIG. 2, base 14 is formed with a plurality of base prongs 24*a, b* and *c*. Base prongs 24*a, b* and *c* can be integrally formed on base 14 by means well-known in the pertinent art such as by injection molding. For this reason, base 14 is preferably made of a high-strength plastic.

Trash bag holder 10 is also seen to include a plurality of support struts 16*a, b* and *c* which are preferably made by resilient plastic and formed as hollow tubular members which can provide sufficient support for holding a filled bag 12 in a manner to be subsequently discussed.

The appropriate ends of support struts 16*a, b* and *c* are formed with holes which are adaptable for engagement with the respective base prongs 24*a, b* and *c*. For example, support strut 16*a* is formed with a hole that allows operative interference engagement of the strut 16*a* with base prong 24*a*. Likewise, support struts 16*b* and *c* are respectively engageable with base prongs 24*b* and *c*. It is to be understood that support struts 16 can be of solid construction. Further, struts 16*a, b* and *c* can also be made as a telescopic structure in a manner well known in the pertinent art. This telescopic capability allows adjustment of the height of holder 10 to accommodate trash bags 12 of different sizes. Regardless, when prongs 24*a, b* and *c* are incorporated, the requirement for a hole or cavity at the end of each support strut 16, to allow its engagement with appropriate base prongs 24*a, b* and *c* is required. Further, it is to be understood that the description here for engagement of each support strut 16 with a respective base prong 24 is only illustrative. Support struts 16*a, b* and *c* could be respectively joined to base prongs 24*a, b* and *c* by any manner well known in the pertinent art.

FIG. 2 also shows that support ring 18 is formed with a plurality of support prongs 26*a, b,* and *c*. As with the engagement of support struts 16*a, b* and *c* with respective base prongs 24*a, b* and *c*, the support struts 16*a, b* and *c* are also respectively engageable with support prongs 26*a, b* and *c*. Preferably, as with the innerconnection between strut 16 and base prong 24, each strut 16 is formed with holes at its end which appropriately engages with support prongs 26*a, b* and *c*. This interaction can be by interference fit, as previously implied, or each support 16 can be associated and joined to its respective support prong 26 by any manner well known in the pertinent art.

Figure 7:
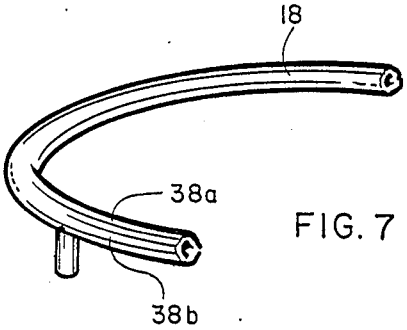
FIG. 7 is a portion of the support ring for an alternate embodiment of the present invention.

As also shown in FIG. 2, support ring 18 is formed with a rough-textured surface. Specifically, FIG. 2 shows support ring 18 formed with a series of cross-hatched ridges 28 which provide a frictional interface between support ring 18 and that portion of bag 12 which is folded over the support ring 18. It is understood that various equivalent configurations for the ridges 28 are possible. Specifically, a series of ribs 38 may be longitudinally formed on the outer surface of support ring 18 in a manner as shown in FIG. 7. Further, support ring 18 can be presented with a roughed surface. The important feature is that support ring 18 be roughly textured in same manner well known in the art which will increase the frictional interface between support ring 18 and trash bag 12.

FIG. 2 also shows clamp 20 formed with a slot 30. As envisioned by the present invention, clamp 20 is arcuate and is of less length than the circumference of support ring 18. Specifically, the length of clamp 20 must be sufficient to allow effective engagement of clamp 20 with support ring 18 while leaving a unengaged area 40 between the ends of the clamp 20 wherein excessive material from bag 12 can be gathered in a manner generally shown in FIG. 1. Further, it is to be understood that a plurality of clamps 20 (not shown) may be used. In this case, it is important that sufficient distances be provided between the facing ends of the individual clamps 20 to allow for the gathering of excess bag material therebetween in a manner as shown in FIG. 1. In FIG. 2 it will be seen that clamp 20 presents a slot 30 which generally faces downward and engages over the top of support ring from a direction opposite to that from which support struts 16 interconnect with support ring 18.

Figure 3:
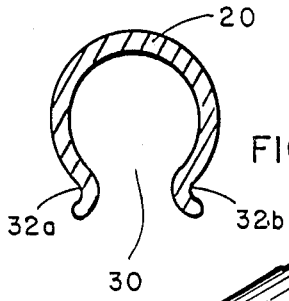
FIG. 3 is a cross-sectional view of the clamp as seen along the line 3—3 in FIG. 2.

Clamp 20 is preferably formed, as generally shown in FIG. 3, with its edges 32*a* and 32*b* flaired to present the slot 30 for easy engagement with support ring 18. More specifically, the flaired ends 32*a* and *b* of clamp 20 allow for a spreading engagement of the clamp 20 over a support ring 18 while it is being engaged with support ring 18. As also seen in FIG. 3, clamp 20 is generally U-shaped with the ends of the U turned inward to provide a surrounding and clamping engagement of the clamp 20 with support ring 18.

Figure 5:
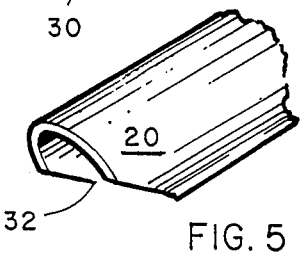
FIG. 5 is a perspective view of an end portion of the clamp.
Figure 6:
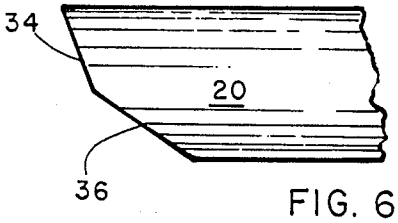
FIG. 6 is a side plan view of the end portion of the clamp shown in FIG. 5.
Figure 4:
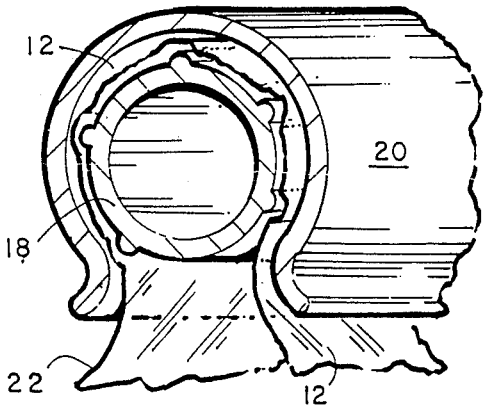
FIG. 4 is a cross-sectional view of the clamp engaged with the support ring as seen along the line 4—4 in FIG. 1.

The ends of clamp 20 are best seen in reference to FIGS. 5 and 6 wherein it is seen that the clamp 20 is formed with a bevel 32 which allows for easier engagement of the clamp 20 with support ring 18. It is anticipated that once initial engagement of clamp 20 with support ring 18 at the area of bevel 32 is attained, the engagement can be propagated along the length of clamp 20 to join clamp with support ring 18. FIG. 6 shows an embodiment of the bevel 32 wherein the bevel 32 is formed with a chamfer 34 and a chamfer 36 each having slightly different angular presentations to facilitate initial engagement of clamp 20 with support ring 18. Once clamp 20 has been placed onto support ring 18, the interaction of the various components is best seen in FIG. 4 where it will be seen that the bag 12 is held between the clamp 20 and the support ring 18 after the lip 22 of bag 12 has been folded over support ring 18.

OPERATION

Trash bag holder 10 of the present invention can be assembled by engaging support struts 16*a, b* and *c* respectively with base prongs 24*a, b* and *c*. This engagement may be by interference fit or by any other means known in the pertinent art. Support ring 18 is then joined with support struts 16*a, b* and *c* by the respective engagement of support prongs 26*a, b* and *c* therewith. Again, the interaction between support prongs 26*a, b* and *c* and support struts 16*a, b* and *c* may be by interference fit or by any other means well known in the pertinent art.

With the trash bag holder 10 thus assembled, a trash bag 12 can be placed on trash bag holder by folding or draping the lip 22 of bag 12 over support ring 18. When bag 12 so positioned, bevel 32 of clamp 20 can be pressed against support ring 18 to cause support ring 18 to enter into clamp 20 via slot 30. The lip 22 of bag 12 can be smoothed around support ring 18 and clamp 20 sequentially engaged therewith to hold trash bag 12 between clamp 20 and support ring 18 in a manner substantially as shown in FIG. 4. When clamp 20 is engaged with support ring 18 in this way, excess material from bag 12 can be gathered between the ends of clamp 20 in area 40. In this manner, a single layer of material from the bag 12 is held between clamp 20 and support ring 18. As previously discussed, the rough-textured surface of support ring 18 can be provided either by cross-hatched ridges 28, as shown in FIG. 2, or the longitudinally formed ribs 38*a* and *b* as substantially shown in FIG. 7. It will be understood by the skilled artesan that various textures for support ring 18 can be provided, all of which are well known in the pertinent art.

While the particular trash bag holder, as herein shown and disclosed in detail, is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

I claim:

1. A trash bag holder to accomodate bags of different sizes comprising:

a circular support ring having a rough-textured surface;

a resilient generally tube-shaped arcuate clamp formed with a longitudinal slot and having inwardly beveled ends for engaging said clamp in partial surrounded relationship with said support ring along a substantial portion of the periphery of said support ring to hold a portion of said bag therebetween and to establish an area between the ends of said clamp where excess bag material can be accumulated.

2. A trash bag holder as cited in claim 1 further comprising:

a base; and a plurality of supports joining said support ring with said base.

3. A trash bag holder as cited in claim 2 wherein:

said base is a circular-shaped ring;

said support ring is of smaller diameter than said base; and said supports are sufficiently resilient to join said base with said support ring.

4. A trash bag holder as cited in claim 3 wherein said clamp has edges which define said slot and said edges are flaired.

5. A trash bag holder as cited in claim 4 wherein said rough-textured surface comprises a plurality of ribs extending longitudinally along said support ring.

* * * * *